US006374909B1

(12) United States Patent
Jeter et al.

(10) Patent No.: US 6,374,909 B1
(45) Date of Patent: Apr. 23, 2002

(54) ELECTRODE ARRANGEMENT FOR ELECTROHYDRODYNAMIC ENHANCEMENT OF HEAT AND MASS TRANSFER

(75) Inventors: Sheldon M. Jeter, Atlanta; Said I. Abdel-Khalik, Tucker, both of GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 730 days.

(21) Appl. No.: 08/690,922

(22) Filed: Aug. 1, 1996

Related U.S. Application Data

(60) Provisional application No. 60/001,781, filed on Aug. 2, 1995.

(51) Int. Cl.[7] ..... F28F 27/00

(52) U.S. Cl. ..... 165/96; 165/109.1; 165/104.23; 417/48

(58) Field of Search ..... 165/109.1, 911, 165/96, 104.23; 417/48, 50

(56) References Cited

U.S. PATENT DOCUMENTS

| | | | | |
|---|---|---|---|---|
| 3,056,587 A | | 10/1962 | Steigerwald | |
| 3,095,163 A | * | 6/1963 | Hill | 417/48 X |
| 3,344,853 A | * | 10/1967 | Singer | 165/104.23 |
| 3,370,644 A | | 2/1968 | Daily et al. | |
| 3,448,791 A | | 6/1969 | Clark | 165/96 |
| 3,778,678 A | * | 12/1973 | Masuda | 417/48 X |
| 3,824,364 A | * | 7/1974 | Cachat | 219/10.51 |
| 3,872,917 A | | 3/1975 | Blomgren, Sr. et al. | |
| 4,079,368 A | * | 3/1978 | DiStefano | 340/324 M |
| 4,256,950 A | * | 3/1981 | Wildgruber | 219/306 |
| 4,401,148 A | | 8/1983 | Yabe et al. | |
| 4,471,833 A | | 9/1984 | Yabe et al. | 165/109.1 |
| 4,515,206 A | | 5/1985 | Carr | |
| 4,651,806 A | | 3/1987 | Allen et al. | 165/96 |
| 4,656,339 A | * | 4/1987 | Grise | 219/528 |
| 4,890,667 A | | 1/1990 | Lessor et al. | |
| 4,924,937 A | | 5/1990 | Beal et al. | |

FOREIGN PATENT DOCUMENTS

| | | | |
|---|---|---|---|
| SU | 879241 | * 11/1981 | 165/104.23 |
| SU | 879249 | * 11/1981 | 165/104.23 |

OTHER PUBLICATIONS

Author Unknown, "Dielectrics in Electric Fields", C & EN, May 14, 1956, pp. 2370–2372.*

* cited by examiner

*Primary Examiner*—Leonard Leo
(74) *Attorney, Agent, or Firm*—Thomas, Kayden, Horstemeyer & Risley LLP

(57) ABSTRACT

An electrode arrangement for electrohydrodynamic (EHD) enhancement of heat and mass transfer is disclosed. Electrodes of alternating polarity are embedded within a nonconductive heat transfer wall material and are connected to a high voltage source at either end of the heat transfer wall material where the heat transfer wall material passes through a tube sheet, fitting or other confinement. When voltage from the high voltage source is applied to the alternating electrodes, electric field gradients are created on both the interior and exterior heat transfer surfaces of the heat transfer wall material. Regions of intense electric field gradient reside in close proximity to both heat transfer surfaces, thus when nonconductive fluids pass over the heat transfer surfaces, bubbles are repelled from the regions of strong electric field gradients above the electrodes and additional fluid is attracted into these regions. The result is simultaneous augmentation of heat and mass transfer, particularly by evaporation and condensation, on both sides of the heat transfer wall material.

18 Claims, 4 Drawing Sheets

ELECTRODE ARRANGEMENT FOR ELECTROHYDRODYNAMIC ENHANCEMENT OF HEAT AND MASS TRANSFER

CROSS REFERENCES TO RELATED APPLICATIONS

This application claims the benefit of U.S. Provisional Application No. 60/001,781 filed Aug. 2, 1995.

BACKGROUND OF THE INVENTION

This invention relates generally to a method and apparatus for transferring heat in a heat exchanger, more particularly, to an electrode arrangement for optimizing electrohydrodynamic (EHD) enhancement of heat and mass transfer.

It has been well known in the art that electric fields can have an effect upon heat transfer. It is further known that the rate at which liquid at one temperature vaporizes when in contact with a surface at a higher temperature can be enhanced by locating that surface within the electric field generated by an electrode, insulated from the surface and connected to a source of high voltage. Despite this knowledge, commercial use of such phenomenon, to which the general description electrohydrodynamic (EHD) enhancement has been applied, has been limited.

In order to effectively facilitate EHD enhancement of heat transfer, it is necessary to create an electric field that is as strongly inhomogeneous as possible. More importantly, the regions of the electric field having the strongest electric field gradients should be as close as possible to the heat transfer surface. Given these guidelines, the electrode designs that have been described in the literature appear to be limited in performance. The typical design uses a metal pipe as one electrode and a parallel system of wires as the second electrode. While the field around the small diameter wires can be highly inhomogeneous, the field around the large diameter pipe tends to be more uniform. Indeed the presence of surface enhancements such as low fins seems to be necessary for good performance in this general arrangement. Since the pipe is the actual heat transfer surface, it seems to be particularly disadvantageous that the strongest gradient is near the wires not near the pipe. Agitation of bubbles and droplets near the pipe and disruption of the surrounding thermal boundary layers should be the aim of the design with the goal of enhancing two phase heat transfer to or from the pipe.

Another design is disclosed in the patent of Allen et al., U.S. Pat. No. 4,651,806, issued Mar. 24, 1987. Allen et al. disclose a "shell-tube" type heat exchanger that employs EHD technology. The device of Allen et al. has a plurality of spaced-apart heat exchange tubes that pass through a casing. In addition, an electrode is located within the casing but insulated from both the casing and the tubes. Heat exchange takes place through the tube walls between a first fluid medium within the tubes and a second medium outside the tubes but within the casing when the electrode is excited to high voltage. However, because the electrode is insulated from the tubes (the heat transfer surface), the strongest electric field gradients do not reside near the heat transfer surface. Thus, the resulting heat transfer due to EHD effect is not optimized.

While apparatuses have employed EHD effects to enhance the rate of heat transfer, it appears that none have employed a commercially feasible electrode arrangement to optimize heat and mass transfer from a heat transfer surface to a dielectric fluid. In addition, such apparatuses are fragile, therefore requiring frequent maintenance, and are difficult to manufacture.

What is needed, therefore, in the art, is an electrode arrangement for electrohydrodynamic (EHD) enhancement of heat and mass transfer in dielectric fluids that will place the regions of strongest electric field gradient at or near the heat transfer surface. Moreover, what is needed but unavailable in the art is a rugged electrode arrangement that will provide for simultaneous heat and mass transfer enhancement on both sides of the heat transfer surface.

SUMMARY OF THE INVENTION

EHD enhancement of heat and mass transfer utilizes an electric field to influence fluid flows or related transport effects, such as bubble growth or departure, that augment heat and mass transfer in a dielectric fluid. While the interaction of an electric field with a fluid is difficult to predict or even interpret, it appears that the dielectrophoretic force predominates in an uncharged, nonconductive fluid. The dielectrophoretic force requires a gradient in the electric field and a nonuniform electric permittivity. A prime example of nonuniform permittivity is a droplet in a vapor medium, The droplet is a fluid lump of higher electric permittivity immersed in a vapor medium of relatively lower permittivity. In this situation, the dielectrophoretic force tends to drive the droplet toward a region of higher electric field strength. In contrast, a vapor bubble (a region of lower permittivity) immersed in a liquid (of higher electric permittivity) will be driven to a region where the electric field strength is lower. The strength of the dielectrophoretic force on a spherical droplet or bubble is roughly proportional to two factors, the difference in permittivity between the two phases and the gradient of the square of the electric field strength.

The most effective EHD technology should create an electric field that is as strongly inhomogeneous as possible. In addition, the field should be oriented so that phenomena that enhance heat transfer are stimulated. In an evaporator for example, vapor bubbles should be forced away from the surface and liquid should be attracted. It is therefore axiomatic that the strongest electric field gradients should reside as close as possible to the heat transfer surface.

In the present invention, this advantageous result is achieved by embedding a set of electrodes within the heat transfer wall material. Heat transfer wall material having interior and exterior heat transfer surfaces is typically attached to a tube sheet, fitting or other confinement typically used in refrigeration evaporators, evaporative condensers, cooling towers, and other evaporators and boilers. The heat transfer wall material of the present invention is generally in the shape of a tube or plate, but can also be formed to have other geometric characteristics.

In a first embodiment of the present invention, a set of electrodes is embedded within the heat transfer wall material between the exterior heat transfer surface and the interior heat transfer surface. A set of electrodes comprises one or more electrodes adapted to be excited to a large relative voltage with respect to another set of electrodes. One set of electrodes will be at a higher electrical potential relative to the other. The higher potential set will be referred to as the positive set, and the other set will be referred to as the negative set. Only the relative potential of the electrodes is of functional importance. For convenience or safety, one set can be near or at ground potential. For example, if the negative electrode is grounded, the positive electrode would be above ground potential. If the positive electrode is grounded, then the negative electrode would be below ground potential.

When the heat transfer wall material is tube-shaped, the set of electrodes forms helices which extend throughout the length of the wall material. The electrodes are arranged such that they are spaced apart and alternate in polarity. When the heat transfer wall material is plate-shaped, the set of electrodes are interdigitated and extend throughout the length of the wall material. Again, the electrodes are arranged such that they are spaced apart and alternate in polarity. In both the tube-shaped and plate configuration, the electrodes are connected to the high voltage source at either end of the heat transfer wall material, where the heat transfer wall material passes through a tube sheet (a bulkhead penetrated by heat exchanger tubes, plates or other heat transfer wall material), fitting, or other confinement. When more than one electrode of each polarity comprises the set of electrodes, the electrodes having the same polarity are ganged together, in any number of ways commonly known in the art, to facilitate connection to the high voltage source.

When a high positive and high negative voltage is supplied to the electrode set an electric field results. Electric field gradients are produced along the length of the interior heat transfer surface and the exterior heat transfer surface of the heat transfer wall material. The regions of intense electric field gradient reside closest to the heat transfer surfaces. When nonconductive fluids pass along both surfaces of the heat transfer wall material, the strong electric field gradients near the heat transfer surfaces repel vapor bubbles from these regions and attract the liquid. The result is augmented evaporation.

In a second embodiment of the present invention, two distinct sets of electrodes are embedded in the heat transfer wall material. Like the first embodiment, electrodes of alternating polarity extend throughout the length of the heat transfer wall material. Unlike the first embodiment, however, all of the electrodes are not simultaneously electrified. Instead, each set of electrodes is alternately and independently electrified. When the first set of electrodes is electrified, the second set of electrodes therebetween remain uncharged. When this occurs, the nonconductive fluid moves to the electric field gradients above the charged electrode set. When the second set is electrified, the first set therebetween remains uncharged and the nonconductive fluid is then attracted to the electric field gradients above the second charged electrode set. The resulting agitation produced by the wavelike motion of the fluid layer thus increases evaporation.

While this embodiment can be employed using the tube-shaped heat transfer wall material, it is particularly suited for heat transfer wall material in the form of plates for cooling tower applications. It should be evident to those skilled in the art that more than two distinct sets of electrodes can be used in this embodiment.

It is, therefore, an object to the invention to provide a method and apparatus for improving the heat and mass transfer rate in a heat exchanger.

A second object of the invention is to provide an electrode design for a heat exchanger that will result in augmented heat transfer, particularly evaporation.

Another object of the invention is to provide an electrode design for an electrically nonconducting heat transfer wall material which will compensate for the relatively low thermal conductivity of the wall material by enhancing heat transfer on both sides of the wall surface.

A further object of the invention is to provide an electrode design for a heat exchanger which will eliminate the need for fragile and complicated arrays of wire electrodes.

A still further object of the invention is to provide an electrode design for a heat exchanger whereby the electrodes are securely and safely embedded within the wall material, thereby allowing the high voltage electrical connections to be made at either end of the heat transfer wall material where the heat transfer wall material passes through a tube sheet, fitting, or other confinement.

An additional object of the present invention is to provide an apparatus for enhancing heat and mass transfer in dielectric fluids using EHD that is sturdy in construction and simple to manufacture.

These and other objects are attained by the present invention, which relates to an apparatus that utilizes electric field gradients to influence fluid flows and related transport effects, such as bubble growth or departure, that augment heat and mass transfer in a dielectric fluid. Electrodes of alternating polarity are buried in a dielectric heat transfer wall material. The regions of highest electric field gradient are near the heat transfer surfaces and provide for simultaneous augmentation of heat and mass transfer on both sides of the wall material. In an alternative embodiment, electrodes can be buried in a fill material for application in cooling towers. In either application but especially the latter, it is possible to provide two sets of electrodes that can be alternately electrified.

Additional objects and advantages of the invention will become apparent from the following detailed description, with reference to the accompanying drawings.

DETAILED DESCRIPTION OF THE PREFERRED EMBODIMENT

Figure 1:
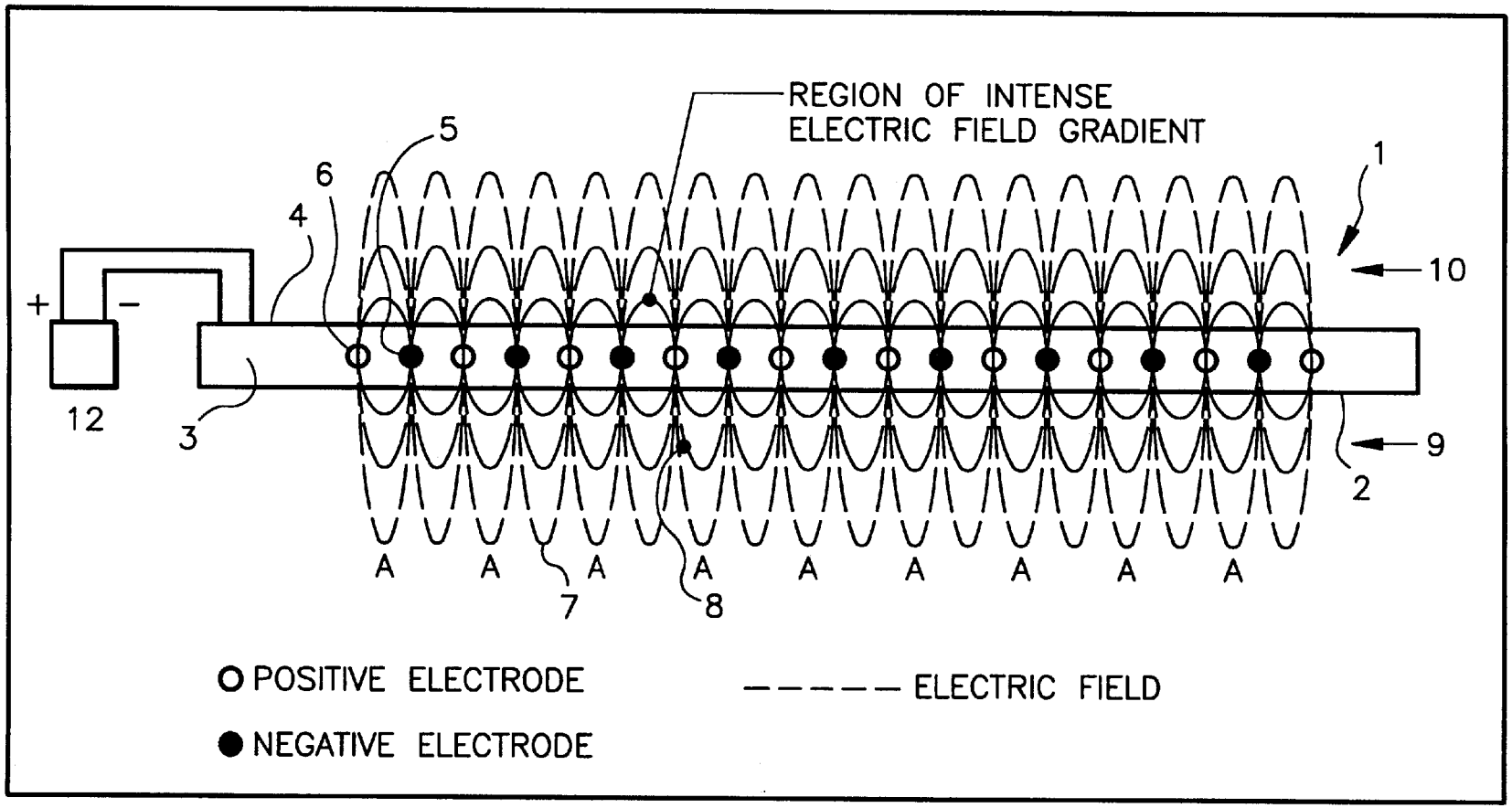
FIG. 1 is a partial cross-sectional view of the heat transfer wall material of the present invention illustrating the novel embedded electrode arrangement.

The following detailed description will be given with reference to the sections of heat transfer wall material shown in FIGS. 1–4; however, it should be noted that several other forms of heat transfer wall material are applicable to the present invention, including; walls of varying geometric design, such as, but not limited to, plates, fill material having varying degrees of thickness, and other various structures having a thickness capable of encapsulating the electrodes. Referring now to the drawings, in which like reference characters indicate like parts throughout the several views, numeral 1 of FIG. 1 illustrates the cross-section of a heat transfer wall material embedded with electrodes. A single set of electrodes A comprising one or more electrodes 6 adapted to be excited to a high positive voltage and a corresponding number of electrodes 5 adapted to be excited to a high negative voltage are embedded along the length of the heat transfer wall material 3. The electrodes are bounded above by an exterior heat transfer surface 4 and bounded below by an interior heat transfer surface 2 and are arranged in a spaced array such that they alternate in polarity along the length of the heat transfer wall material 3 when charged.

Figure 2:
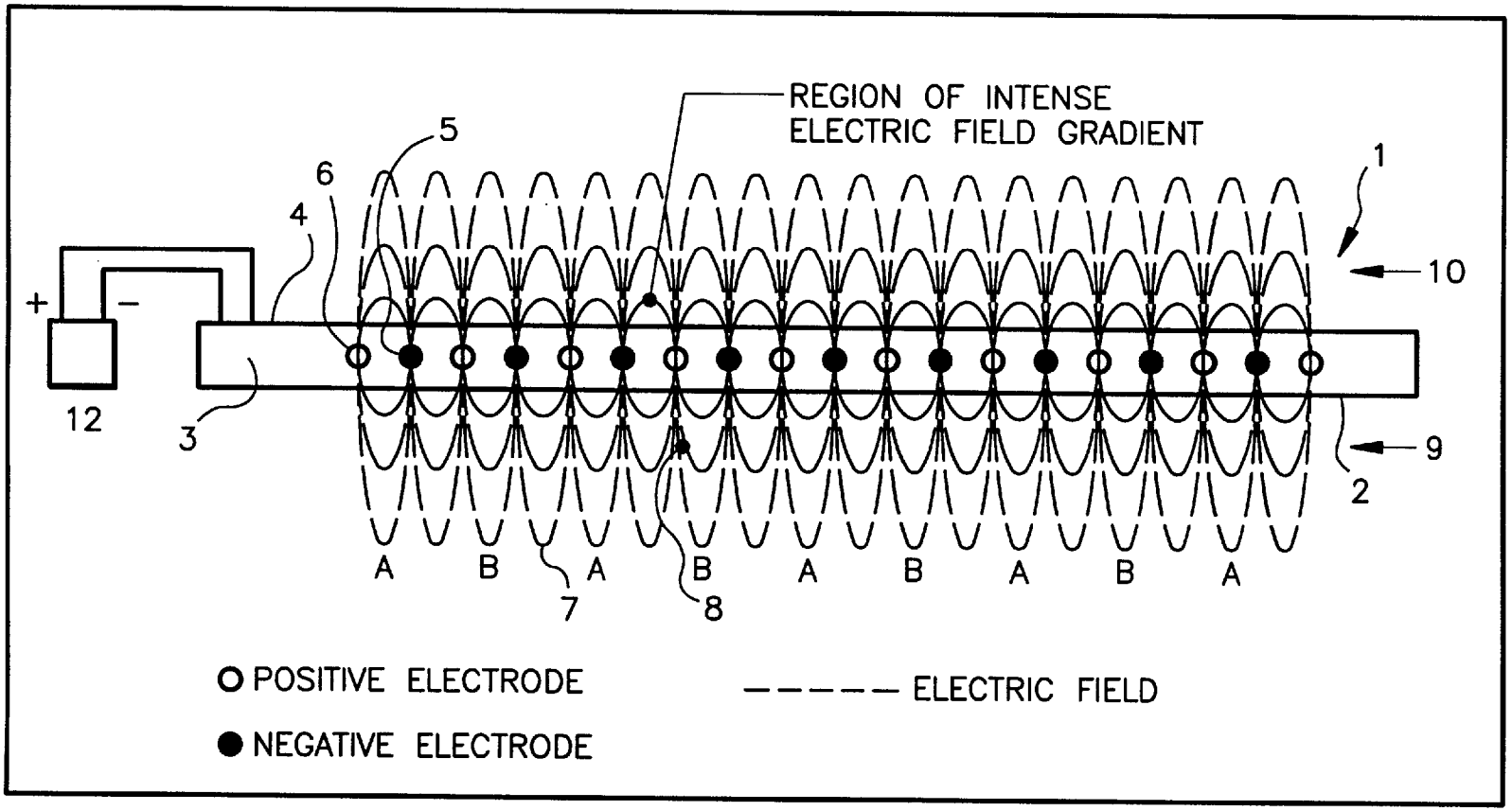
FIG. 2 is a partial cross-sectional view of the heat transfer wall material of the present invention illustrating a second embodiment of the novel embedded electrode arrangement.

Numeral 21 of FIG. 2 illustrates a similar cross-section of a heat transfer wall material 23 embedded with electrodes. In this second embodiment, however, two distinct sets of electrodes A and B are alternately embedded within the heat transfer wall material 23. The electrodes 25 and 26 are arranged such that they alternate in polarity when charged as described above with reference to the embodiment shown in FIG. 1, but unlike the first embodiment, each set of electrodes A and B is adapted to be alternately and independently electrified. In either embodiment of the invention, the electrodes 25 and 26 are helically wound within the heat transfer wall material 23 when the heat transfer wall material 23 is tube-shaped, and the electrodes 25 and 26 are interdigitated within the heat transfer wall material 23 when the heat transfer wall material 23 is in the form of a plate or some other planar structure. It should be realized that other electrode geometries are possible and are considered to be within the scope of the present invention.

Figure 3:
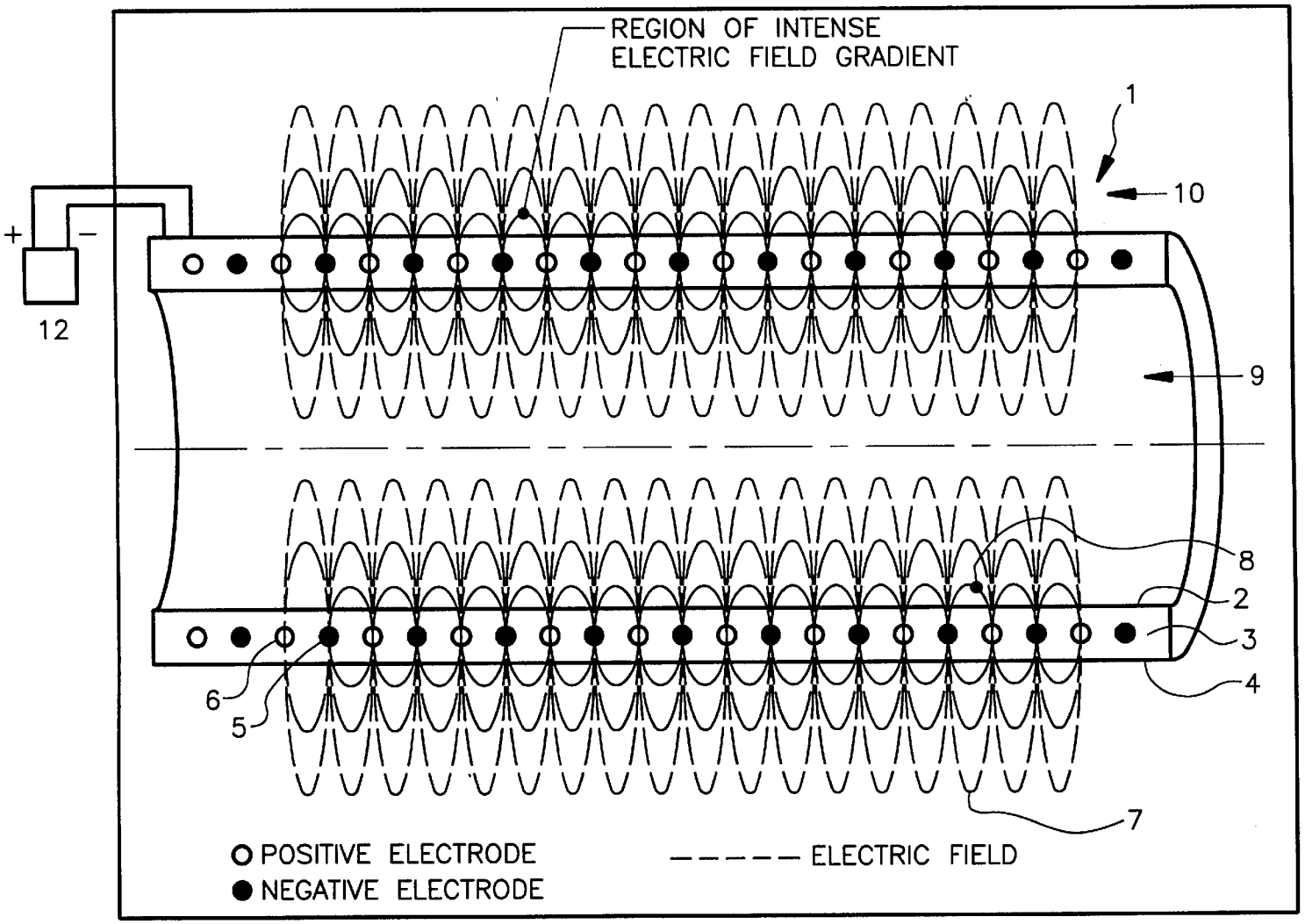
FIG. 3 is a cross-sectional view of a tube-shaped heat transfer wall material of the present invention illustrating the novel embedded electrode arrangement.
Figure 4:
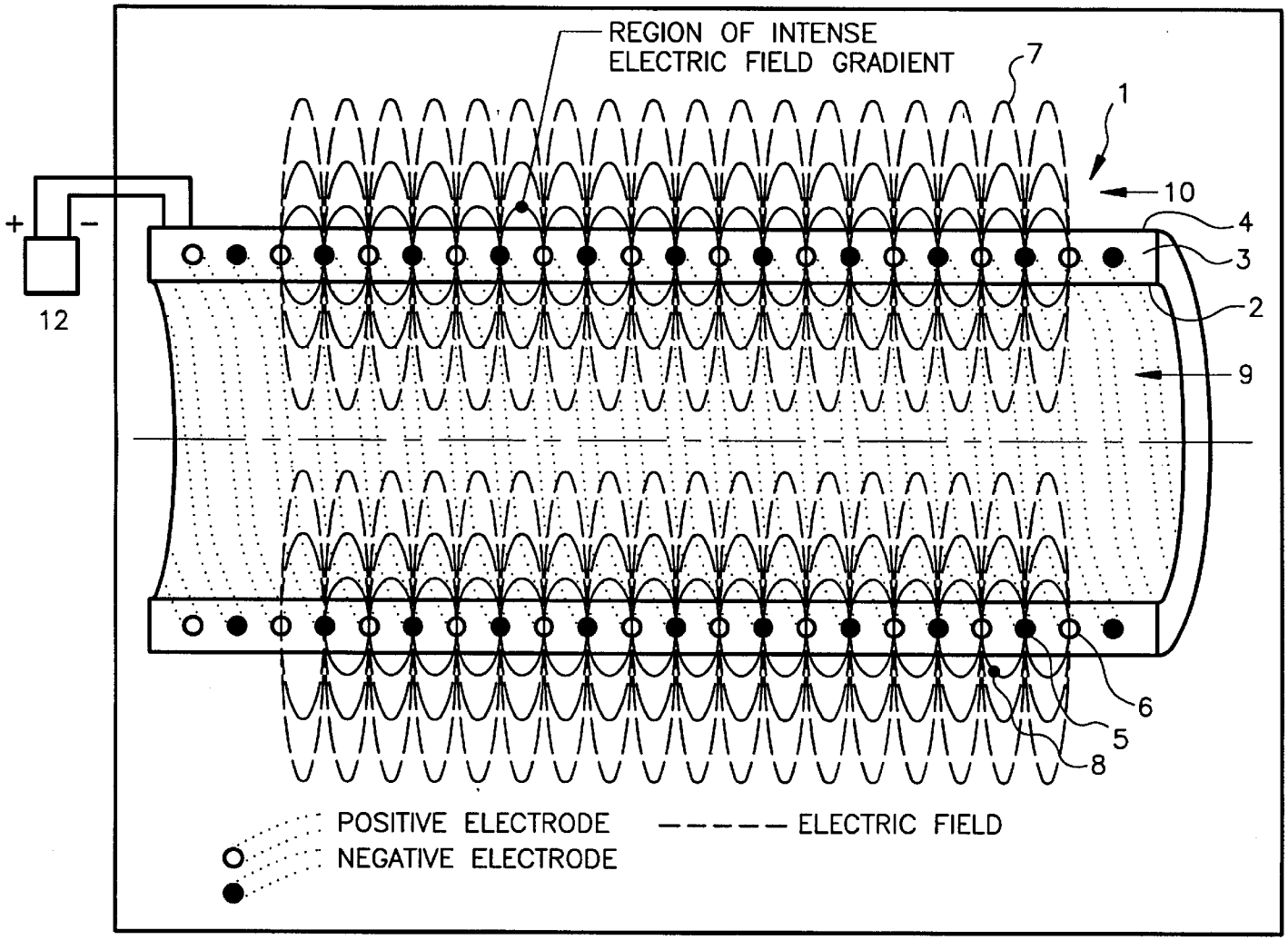
FIG. 4 is a cross-sectional view of a tube-shaped heat transfer wall material of the present invention illustrating the novel helical path of the embedded electrode arrangement.
Figure 1:
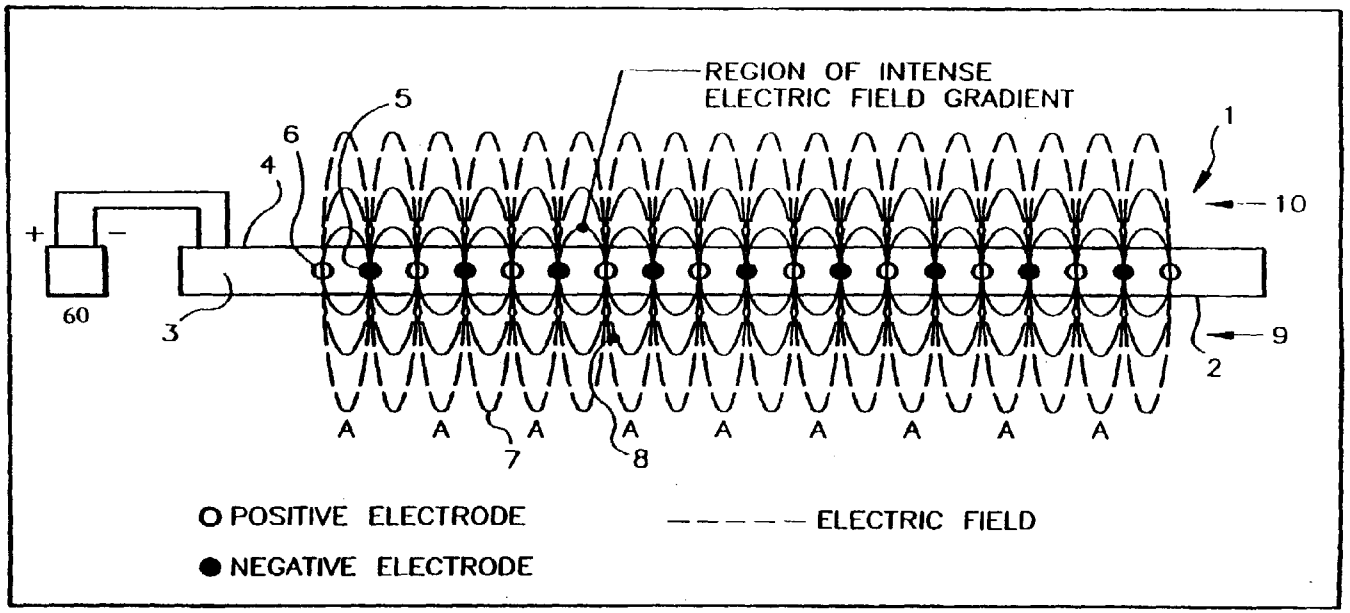
Figure 2:
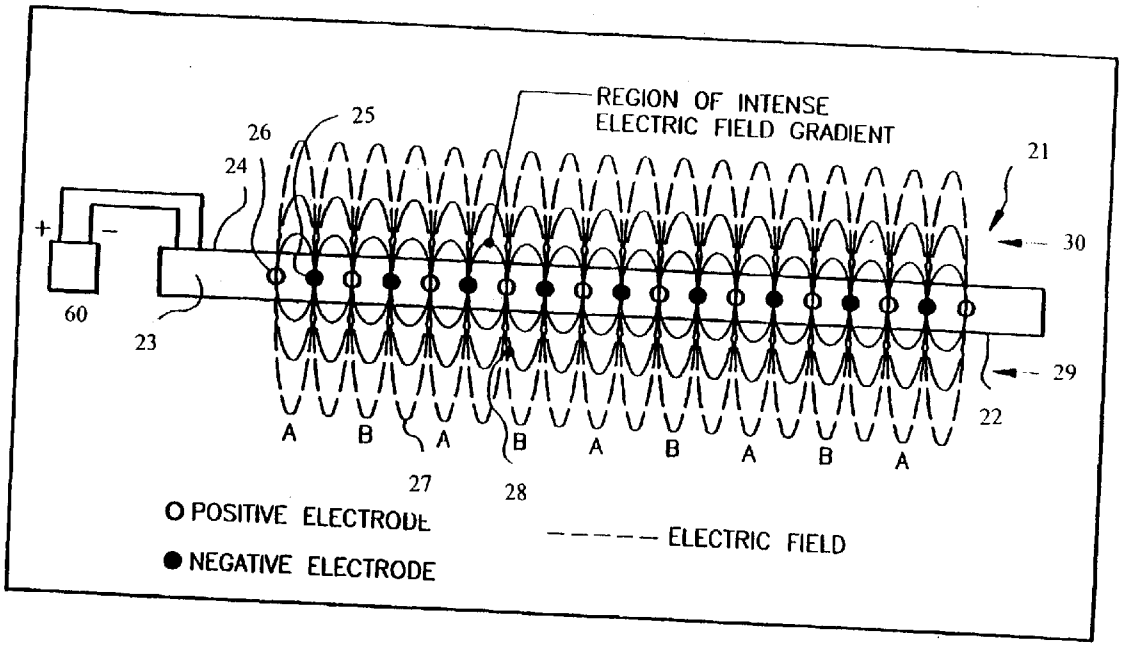
Figure 3:
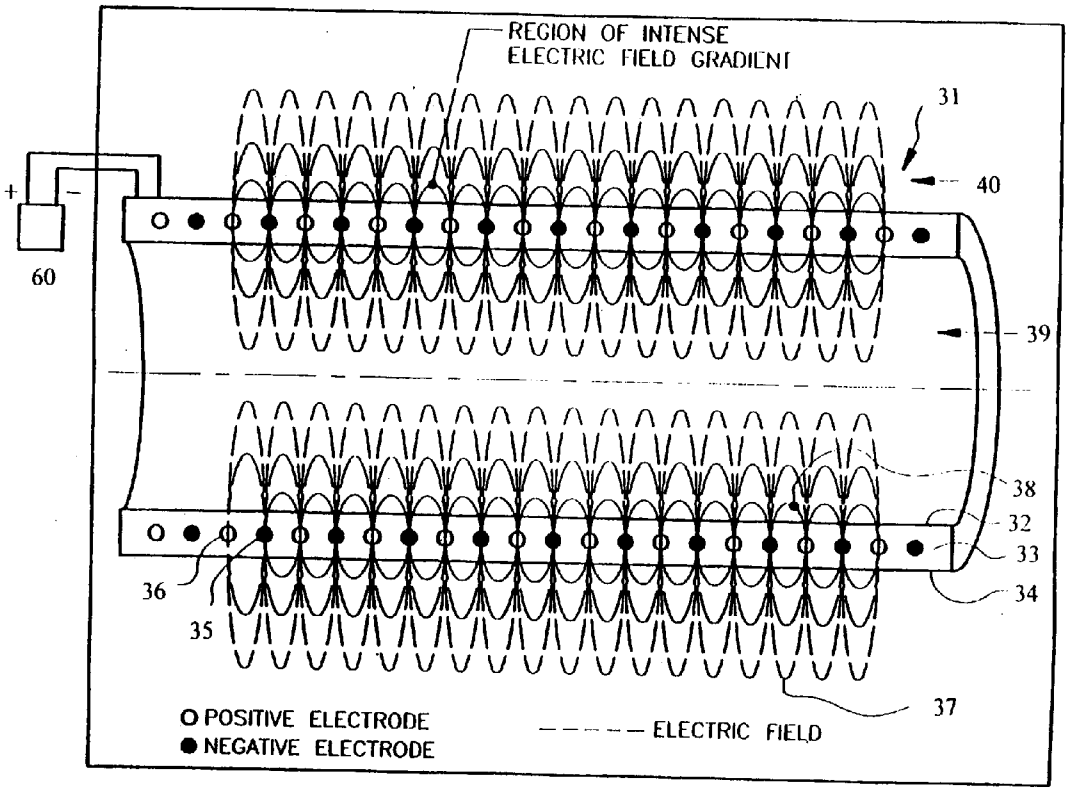
Figure 4:
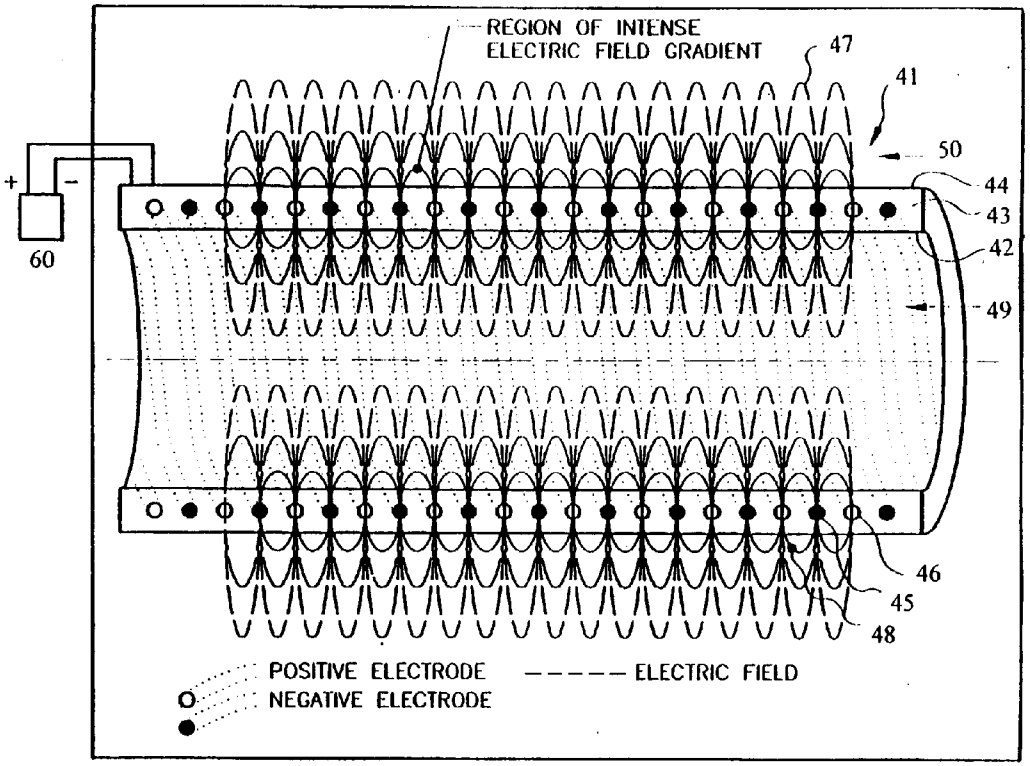

In FIGS. 3 and 4, numerals 31 and 41 represent the heat transfer wall material 33 and 43 embedded with electrodes 35 and 36, and 45 and 46, respectively. In both FIGS. 3 and 4, a cross-section of a tube-shaped heat transfer wall material 33 and 34 are shown. In particular, FIG. 4 shows in dashed lines, the helical path of alternating electrodes 45 and 46. FIGS. 3 and 4 are shown with one set of electrodes 35 and 36, and 45 and 46, respectively. However, it is to be understood that tube-shaped heat transfer wall material of FIGS. 3 and 4 can include more than one set of electrodes.

In both of the above-mentioned embodiments, the electrodes 35 and 36, and 45 and 46 are connected to one or more high voltage sources (shown schematically at 60) at either end of the heat transfer wall material where the heat transfer wall material passes through a tube sheet, fitting, or other confinement. Additionally, when more than one electrode 35 and 36, and 45 and 46 comprise the set or sets of electrodes embedded within the heat transfer wall material 33 and 43, all of the electrodes 35 and 45 adapted to be charged to a negative polarity are ganged together, and all of the electrodes 36 and 46 adapted to be charged to a positive polarity are ganged together to facilitate connection to the high voltage source 60 at either end of the heat transfer wall material 33 and 43.

Operation

In a preferred embodiment of the present invention, as shown in FIGS. 1, 3 and 4, a set of electrodes embedded in the heat transfer wall material 3, 33 and 43 is charged via a high voltage source 60. Electrode 5, 35 and 45 is thereby negatively charged while electrode 6, 36 and 46 is simultaneously positively charged. As a result, electric field gradients 7, 37 and 47 are created about the interior heat transfer surface 2, 32 and 42 and the exterior heat transfer surface 4, 34 and 44 of the heat transfer wall material 3, 33 and 43. Due to the alternating polarity of the electrodes 5, 35 and 45 and 6, 36 and 46 within the heat transfer wall material 3, 33 and 43, regions of intense electric field gradient 8, 38 and 48 are formed near the interior heat transfer surface 2, 32 and 42 and the exterior heat transfer surface 4, 34 and 44 along the length of the heat transfer wall material 3, 33 and 43. As the nonconductive fluids 9, 39 and 49, and 10, 40 and 50 pass along the interior heat transfer surface 2, 32 and 42, and exterior heat transfer surface 4, 34 and 44 respectively, bubbles are repelled from the regions of intense electric field gradient 8, 38 and 48 and liquid is attracted into these regions, thus enhancing evaporation. Although the heat transfer wall material 3, 33 and 43 is constructed of an electrically nonconducting material which will likely have a relatively lower thermal conductivity, the unique electrode arrangement within the heat transfer wall material 3, 33 and 43 compensates by enhancing heat and mass transfer on both surfaces (2, 32 and 42, and 4, 34 and 44) of the heat transfer wall material 3, 33 and 43. Moreover, there is no longer a need for introducing additional electrodes such as wires into the nonconductive fluids 9, 39 and 49 and 10, 40 and 50. Since the electrodes 5, 35 and 45 and 6, 36 and 46 are securely embedded in the heat transfer wall material 3, 33 and 43, safety is enhanced as the high voltage electrical connections are made at either end of the heat transfer wall material 3, 33 and 43 where the heat transfer wall material 3, 33 and 43 passes through a tube sheet, fitting or other confinement.

In a second embodiment of the invention, two distinct sets of electrodes are embedded in the heat transfer wall material 23. As shown in FIG. 2, a first set of electrodes A comprising an electrode 25 adapted to be charged to a high negative voltage and electrode 26 adapted to be charged to a high negative voltage, and a second set of electrodes B comprising a second electrode 25 adapted to be charged to a high negative voltage and a second electrode 26 adapted to be charged to a high positive voltage are alternately embedded within the heat transfer wall material 23. Each of electrodes A and B is connected to a high voltage source 60 at either end of the heat transfer wall material 23 where the heat transfer wall material 23 passes through a tube sheet, fitting or other confinement. In this embodiment, the sets of electrodes A and B are alternately and independently electrified. When voltage is supplied to the first set of electrodes A, electric field gradients 27 are created about electrodes 25 and 26 of that electrode set on both the interior heat transfer surface 22 and exterior heat transfer surface 24 of the heat transfer wall material 23. Because electrode set B is uncharged during this time, there is no electric field created about electrodes 25 and 26 of electrode set B. Thus, when nonconductive fluids 29 and 30 pass along the interior heat transfer surface 22 and exterior heat transfer surface 24 respectively, additional liquid is attracted to the regions of intense electric field gradient 28 created above and below electrodes 25 and 26 of electrode set A.

When voltage is supplied to the alternate electrode set B, electrode set A remains uncharged. When this occurs, the nonconductive fluids 29 and 30 tend to move to the alternate positions of intense electric field gradient 28 above and below electrodes 25 and 26 of electrode set B. The resulting wavelike motion of the fluid layer thus extends and agitates the available heat transfer surface causing augmented evaporation. This embodiment is particularly suited for use in cooling tower applications where the varying electric field can be used to redistribute the fluid from one region to another.

In either embodiment, electrodes of alternating polarity are buried within a dielectric heat transfer wall material. The regions of highest electric field gradient are near the heat transfer surface on both sides of the heat transfer wall material and provide for simultaneous augmentation of heat and mass transfer, particularly by evaporation and condensation, on both sides of the wall material.

While two distinct embodiments of the electrode arrangement for electrohydrodynamic (EHD) enhancement of heat and mass transfer have been shown and described in detail herein, various other changes and modifications may be made without departing from the scope of the present invention.

What is claimed is:

1. A method of enhancing heat and mass transfer in dielectric fluids, said method comprising the steps of:

embedding a set of electrodes comprising a first electrode and a second electrode in a heat transfer wall material having an interior heat transfer surface and an exterior heat transfer surface, the heat transfer wall material being electrically nonconductive;

insulating the set of electrodes with the heat transfer wall material along said interior and exterior heat transfer surfaces;

exposing said heat transfer wall material to a dielectric fluid; and supplying high voltage to said set of electrodes.

2. The method of claim 1 further comprising the steps of supplying a high negative voltage to said first electrode and a high positive voltage to said second electrode.

3. The method of claim 2 which said wall material has a first end and a second end and said method includes the further step of arranging said set of electrodes within said wall material such that said first electrode and said second electrode alternate in polarity from said first end of said wall material to said second end of said wall material.

4. The method of claim 3 wherein high voltage is simultaneously supplied to said first and second electrodes.

5. The method of claim 4 in which said wall material is tube-shaped and wherein said first and second electrodes are helically disposed within said wall material.

6. The method of claim 4 which said wall material is planar and wherein said first and second electrodes are interdigitatedly arranged within said wall material.

7. The method of claim 3 further comprising the step of embedding two sets of electrodes within said wall material.

8. The method of claim 7, wherein said two sets of electrodes are alternately disposed within said wall material.

9. The method of claim 8 including the step of sequentially supplying high voltage to said two sets of electrodes.

10. An apparatus for enhancing heat and mass transfer when exposed to dielectric fluids, comprising:

a heat transfer wall formed from a heat transfer wall material, the heat transfer wall material being electrically nonconductive;

an interior heat transfer surface defined by the heat transfer wall;

an exterior heat transfer surface defined by the heat transfer wall; and a plurality of high voltage electrodes encased within the heat transfer wall, the heat transfer wall material insulating the high voltage electrodes.

11. The apparatus of claim 10, further comprising an electric field produced by the application of a high voltage to the high voltage electrodes, the electric field extending beyond the exterior and interior heat transfer surfaces, the electric field having an intense electric field gradient in close proximity to the interior and exterior heat transfer surfaces.

12. The apparatus as claimed in claim 11, wherein each of the high voltage electrodes is capable of being alternatively excited to a high positive voltage and a high negative voltage.

13. The apparatus as claimed in claim 11, wherein the high voltage electrodes are capable of being excited to high voltage simultaneously.

14. The apparatus as claimed in claim 11, further comprising:

the heat transfer wall having a first end and a second end; and a high voltage connection disposed on each of the high voltage electrodes at the first end of the heat transfer wall.

15. The apparatus as claimed in claim 11, wherein the plurality of high voltage electrodes are capable of being electrified sequentially.

16. The apparatus as claimed in claim 11, wherein the heat transfer wall is tube-shaped and the high voltage electrodes are encased within the heat transfer wall in a helical orientation.

17. The apparatus as claimed in claim 11, wherein the heat transfer wall is planar and the high voltage electrodes are encased within the heat transfer wall in an interdigitated orientation.

18. The apparatus as claimed in claim 11, wherein the plurality of high voltage electrodes further comprises a first electrode and a second electrode alternatively encased within the heat transfer wall.

* * * * *

UNITED STATES PATENT AND TRADEMARK OFFICE

CERTIFICATE OF CORRECTION

PATENT NO. : 6,374,909 B1
DATED : April 23, 2002
INVENTOR(S) : Sheldon M. Jeter et al.

It is certified that error appears in the above-identified patent and that said Letters Patent is hereby corrected as shown below:

Title page,
Title page should be deleted to be replaced with the attached title page.

Drawings,
Drawing sheets consisting of Figs. 1 - 4, should be deleted to be replaced with the drawing sheets, consisting of Figs. 1 - 4, as shown on the attached pages.

Column 5,
Line 23, delete “34” and insert -- 43 --.

Column 7,
Line 16, after “claim 2”, insert -- in --.
Line 22, after “claim 3”, insert -- , --.

Signed and Sealed this

Twenty-fourth Day of December, 2002

JAMES E. ROGAN
*Director of the United States Patent and Trademark Office*

(12) United States Patent
Jeter et al.

(10) Patent No.: US 6,374,909 B1
(45) Date of Patent: Apr. 23, 2002

(54) ELECTRODE ARRANGEMENT FOR ELECTROHYDRODYNAMIC ENHANCEMENT OF HEAT AND MASS TRANSFER

(75) Inventors: Sheldon M. Jeter, Atlanta; Said I. Abdel-Khalik, Tucker, both of GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 730 days.

(21) Appl. No.: 08/690,922

(22) Filed: Aug. 1, 1996

Related U.S. Application Data

(60) Provisional application No. 60/001,781, filed on Aug. 2, 1995.

(51) Int. Cl.[7] ..... F28F 27/00

(52) U.S. Cl. ..... 165/96; 165/109.1; 165/104.23; 417/48

(58) Field of Search ..... 165/109.1, 911, 165/96, 104.23; 417/48, 50

(56) References Cited

U.S. PATENT DOCUMENTS

| | | | | | |
|---|---|---|---|---|---|
| 3,056,587 | A | | 10/1962 | Steigerwald | |
| 3,095,163 | A | * | 6/1963 | Hill | 417/48 X |
| 3,344,853 | A | * | 10/1967 | Singer | 165/104.23 |
| 3,370,644 | A | | 2/1968 | Daily et al. | |
| 3,448,791 | A | | 6/1969 | Clark | 165/96 |
| 3,778,678 | A | * | 12/1973 | Masuda | 417/48 X |
| 3,824,364 | A | * | 7/1974 | Cachat | 219/10.51 |
| 3,872,917 | A | | 3/1975 | Blomgren, Sr. et al. | |
| 4,079,368 | A | * | 3/1978 | DiStefano | 340/324 M |
| 4,256,950 | A | * | 3/1981 | Wildgruber | 219/306 |
| 4,401,148 | A | | 8/1983 | Yabe et al. | |
| 4,471,833 | A | | 9/1984 | Yabe et al. | 165/109.1 |
| 4,515,206 | A | | 5/1985 | Carr | |
| 4,651,806 | A | | 3/1987 | Allen et al. | 165/96 |
| 4,656,339 | A | * | 4/1987 | Grise | 219/528 |
| 4,890,667 | A | | 1/1990 | Lessor et al. | |
| 4,924,937 | A | | 5/1990 | Beal et al. | |

FOREIGN PATENT DOCUMENTS

| | | | |
|---|---|---|---|
| SU | 879241 | * 11/1981 | 165/104.23 |
| SU | 879249 | * 11/1981 | 165/104.23 |

OTHER PUBLICATIONS

Author Unknown, "Dielectrics in Electric Fields", C & EN, May 14, 1956, pp. 2370–2372.*

* cited by examiner

*Primary Examiner*—Leonard Leo
(74) *Attorney, Agent, or Firm*—Thomas, Kayden, Horstemeyer & Risley LLP

(57) ABSTRACT

An electrode arrangement for electrohydrodynamic (EHD) enhancement of heat and mass transfer is disclosed. Electrodes of alternating polarity are embedded within a nonconductive heat transfer wall material and are connected to a high voltage source at either end of the heat transfer wall material where the heat transfer wall material passes through a tube sheet, fitting or other confinement. When voltage from the high voltage source is applied to the alternating electrodes, electric field gradients are created on both the interior and exterior heat transfer surfaces of the heat transfer wall material. Regions of intense electric field gradient reside in close proximity to both heat transfer surfaces, thus when nonconductive fluids pass over the heat transfer surfaces, bubbles are repelled from the regions of strong electric field gradients above the electrodes and additional fluid is attracted into these regions. The result is simultaneous augmentation of heat and mass transfer, particularly by evaporation and condensation, on both sides of the heat transfer wall material.

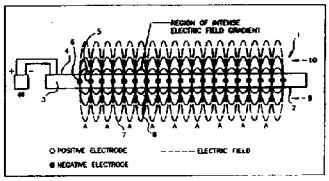

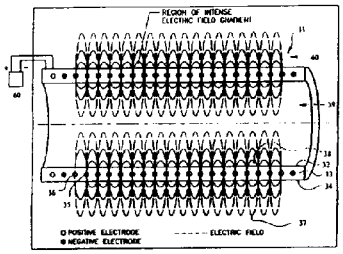

18 Claims, 4 Drawing Sheets